United States Patent [19]

Ludwig

[11] 4,338,512

[45] Jul. 6, 1982

[54] TRUCK SAFETY RECORDER

[76] Inventor: Walter F. Ludwig, 3434 E. Oregon, Phoenix, Ariz. 85018

[21] Appl. No.: 214,346

[22] Filed: Dec. 8, 1980

[51] Int. Cl.[3] ..... G07C 5/04

[52] U.S. Cl. ..... 235/92 T; 235/92 AC; 368/5

[58] Field of Search ..... 235/92 T, 92 TC, 92 PD, 235/92 AC; 368/5, 6; 364/424, 569; 346/20, 33 D, 18

[56] References Cited

U.S. PATENT DOCUMENTS

| | | | |
|---|---|---|---|
| 3,099,817 | 7/1963 | Kendall | 235/92 TC |
| 3,252,620 | 5/1966 | Houle et al. | 235/92 FL |
| 3,665,165 | 5/1972 | Strandberg et al. | 235/92 T |
| 3,878,371 | 4/1975 | Burke | 235/92 PD |
| 3,965,669 | 6/1976 | Larson et al. | 368/5 |
| 3,974,362 | 8/1976 | Willmann et al. | 235/92 AC |
| 4,031,363 | 6/1977 | Freeman et al. | 235/92 T |
| 4,067,061 | 1/1978 | Juhasz | 235/92 TC |
| 4,072,850 | 2/1978 | McGlynn | 340/52 F |
| 4,146,778 | 3/1979 | Wain | 235/92 T |
| 4,180,724 | 12/1979 | Councilman et al. | 235/92 T |

*Primary Examiner*—Joseph M. Thesz

*Attorney, Agent, or Firm*—Cahill, Sutton & Thomas

[57] ABSTRACT

A truck safety recorder is utilized by the driver of a truck for recording the amounts of time that the driver has spent actually driving, the amount of time that the driver has been on duty, and the amount of off duty time that the driver has had for sleeping in accordance with Federal Motor Carrier Safety Regulations. The recorded information is displayed for inspection by highway officials. The truck safety recorder is removably secured to a holder mounted to the vehicle and may be carried on the person of the driver when the truck is not being driven. A clock subsystem within the truck safety recorder generates a periodic timing signal and includes a chronograph, stopwatch, and an alarm for the convenience of the user. A microprocessor subsystem responds to the periodic timing signal by incrementing amounts of time recorded by the truck safety recorder. In addition, the truck safety recorder interfaces with the engine of the truck through an engine enable/disable circuit for disabling the engine under specified conditions.

16 Claims, 6 Drawing Figures

TRUCK SAFETY RECORDER

CROSS-REFERENCE TO RELATED APPLICATION

The present invention is a substitution for patent application, Ser. No. 046,554, filed June 7, 1979, by the present inventor and entitled "TRUCK SAFETY RECORDER", now abandoned.

BACKGROUND OF THE INVENTION

1. Field of the Invention

The present invention relates generally to recording devices for use in conjunction with vehicles, and more particularly, to a portable safety recorder for use by truck drivers to ensure compliance with federal safety highway regulations.

2. Description of the Prior Art

At the present time, the federal motor carrier safety regulations issued by the Bureau of Motor Carrier Safety of the Federal Highway Administration state the following:

a. commercial truck drivers shall not drive the truck more than ten hours per day;
b. the truck driver shall not drive after he has been on duty (driving or not driving) for more than fifteen consecutive hours;
c. after the truck driver has driven for ten hours or has been on duty for fifteen hours, he must spend an eight hour period off duty in order to drive the truck again;
d. the required eight hour off duty period mentioned above may be taken in two rest periods, each lasting for at least two hours;
e. drivers on a weekly schedule may not spend more than sixty hours on duty within any seven consecutive day period; drivers who are not on a weekly schedule may not spend more than seventy hours on duty in any eight consecutive day period.

Federal regulations require truck drivers to maintain a daily log book in which the driver must document his compliance with the above mentioned driving restrictions. Each day, the truck driver must take several minutes to complete his daily log. In many cases, a truck is operated by a pair of drivers who alternate taking their positions behind the steering wheel of the truck. In this event, it is necessary for the first and second drivers to coordinate their respective daily log books with one another. Given the relatively large number of trucks currently being operated, the amount of paperwork, processing, and storage of these daily logs is voluminous. More importantly, it is not uncommon for truck drivers to falsify the daily logs in order to cover more miles than would be possible were the driver to comply with the federal regulations. Incidents of non-compliance with the federal regulations pose a safety risk because drivers operate the truck without having sufficient rest periods.

Accordingly, it is an object of the present invention to eliminate the need for commercial truck drivers to spend time to keep daily logs of the type described above while recording the information normally kept on such logs and displaying the information for inspection by federal authorities.

It is another object of the present invention to record information of the type normally kept by truck drivers in their daily logs and automatically coordinate such information for a pair of truck drivers who alternately drive the same truck.

It is still another object of the present invention to reduce amounts of paperwork and simplify processing and storage of information associated with daily logs of the type mentioned above.

It is a further object of the present invention to provide a recording device which compels the driver or drivers to adhere to federal highway safety regulations.

It is yet another object of the present invention to provide a recording device which can be utilized by commercial truck drivers to indicate compliance with the federal highway safety regulations, which recorder can be carried on the person of the truck driver.

It is still a further object of the present invention to provide a recording device of the type mentioned above which incorporates an alarm clock and a stop watch for the convenience of the user.

These and other objects of the present invention will become apparent to those skilled in the art as the description thereof proceeds.

SUMMARY OF THE INVENTION

Briefly described, and in accordance with one embodiment thereof, the present invention relates to a recording apparatus for use by the driver of a vheicle, the recording apparatus including a first storage device for storing the amount of time that the driver has spent driving the vehicle and a display for displaying the contents of the first storage device. The recording apparatus also includes a periodic time signal generator and a sensor for sensing motion of the vehicle. Control circuitry causes the contents of the first storage device to be incremented upon each occurrence of the periodic time signal provided that the vehicle is in motion. Preferably, the recording apparatus includes a keyed switch into which the driver must insert a corresponding key in order to operate the vehicle. An enable/disable circuit coupled to the engine and responsive to the keyed switch disables the engine unless the driver has inserted his key into the keyed switch.

In order to record on duty time and sleeping (off duty) time for the driver, the recording apparatus may include second and third storage devices and a switch for indicating whether the driver is on duty or off duty. The second or third storage device is incremented upon each occurrence of the periodic time signal as determined by whether the driver is on duty or off duty, respectively. The recording apparatus includes an additional display for displaying stored off duty time. The control circuitry generates an engine shut-down signal in the event that the driver attempts to insert his key into the keyed switch while his switch indicates that he is off duty. The engin shut-down signal is coupled to the enable/disable circuit for disabling the engine, thereby compelling the driver to indicate that he is on duty prior to driving the vehicle.

The control circuitry resets (or zeros) the stored off duty time each time that the driver changes his indicated status from on duty to off duty. The control circuitry resets (or zeros) the stored driving time only after the stored off duty time reaches a predetermined minimum value.

In order to record the accumulated on duty time for the driver over a period of several days or other appropriate time intervals, the control circuitry may include an interval timing mechanism for indicating the passage of each day or other predetermined time interval. The recording apparatus may also include a fourth storage device wherein the control circuitry causes the on duty time stored by the second storage device to be added to the cumulative on duty time stored by the fourth storage device upon the passage of each day or other interval. In order that the accumulated on duty time reflect only the N most recent days or other intervals, additional storage means are provided for storing the on duty time for each of the N most recent days or other intervals. Upon the passage of each day or other time interval, the control circuitry sums the on duty time stored for the N most recent days or other time intervals and stores the result in the fourth storage device. An additional display is provided for displaying the accumulated on duty time stored by the fourth storage device. The control circuitry resets the accumulated on duty time only after the stored off duty time reaches a predetermined minimum value. Preferably, a selector is provided for selecting the value of N.

The periodic time signal generator, storage devices, display switches and selectors may advantageously be contained within an enclosure that is removably secured to a holder mounted to the vehicle to allow the driver to carry the enclosure on his person when he is not operating the vehicle. For the convenience of the driver, the removable enclosure includes a chronograph-type clock mechanism for indicating real time and elapsed stop watch time as controlled by a start/-stop actuator. The chronograph-type clock mechanism also includes an alarm which is actuated when the indicated real time corresponds to a time preselected by the driver.

Recording apparatus of the type described above can be utilized in conjunction with a vehicle driven by two or more drivers. In this event, each of the drivers is provided with his own storage devices, display, keyed switch, on duty/off duty switch, and N value selector. The enable/disable circuitry of the recording apparatus is responsive to the plurality of keyed switches and to the motion signal for disabling the engin if none of the keyed switches has a key inserted therein or if two or more keys are simultaneously inserted when the vehicle is in motion.

BRIEF DESCRIPTION OF THE DRAWINGS

FIG. 6 is a flow chart diagram of the main program software sequence implemented by the microprocessor control circuitry when not implementing the interrupt sequence shown in FIG. 5.

DETAILED DESCRIPTION OF THE PREFERRED EMBODIMENT

Figure 1:
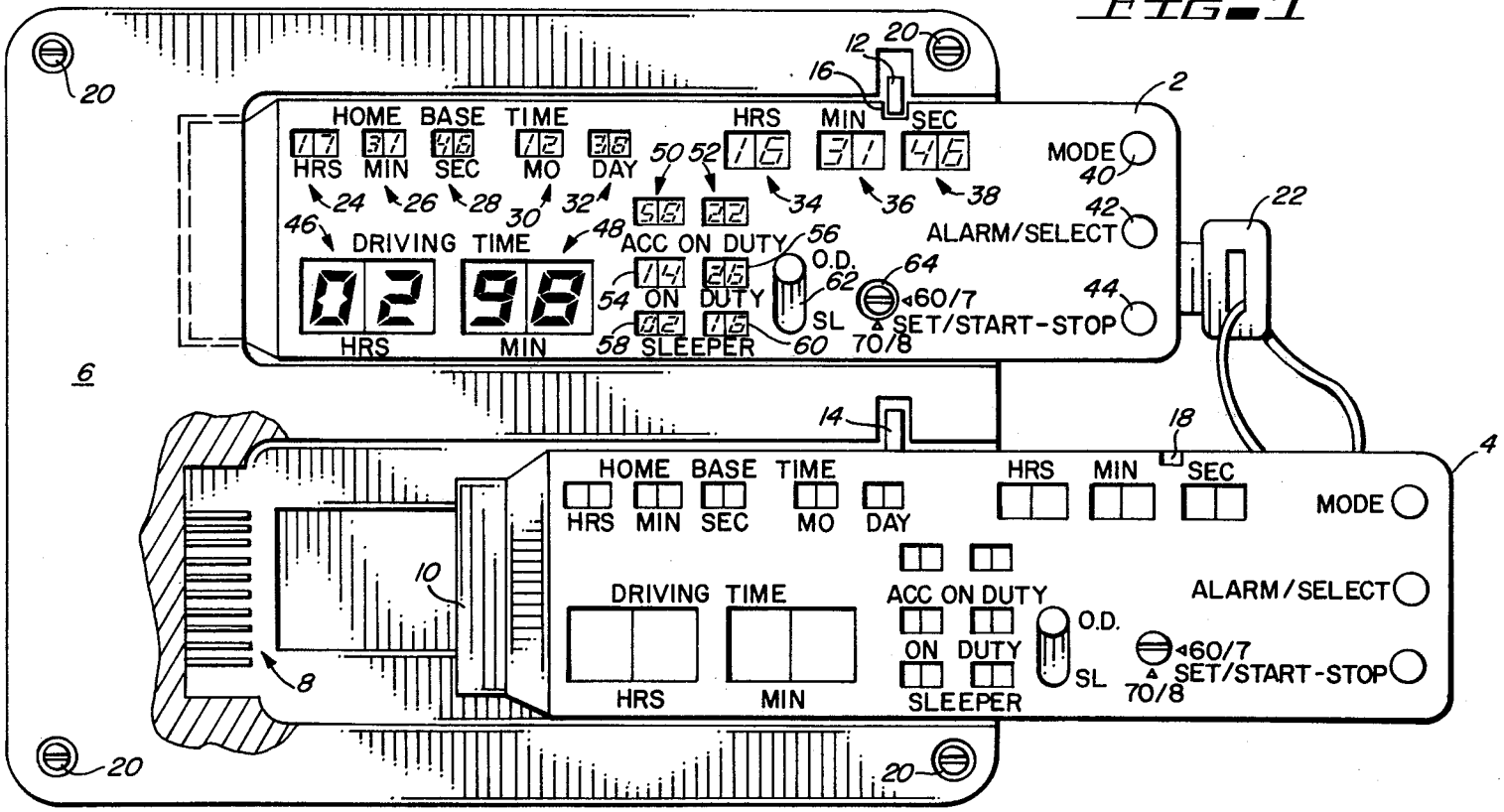
FIG. 1 is a front view of a pair of truck safety recorders removably secured within a holder mounted within a truck.

In FIG. 1, a pair of truck safety recorders 2 and 4 are shown together with a holder or frame 6 within which truck safety recorders 2 and 4 are removably secured. As shown in FIG. 1, truck safety recorder 2 is fully inserted within holder 6 and is electrically coupled thereto. Truck safety recorder 4 is only partially inserted within holder 6, and the cutaway portion of holder 6 reveals a plurality of electrical connector pins generally designated 8 for contacting a corresponding plurality of electrical sockets within portion 10 of truck safety recorder 4. Thus, when either of the truck safety recorders is fully inserted within holder 6, electrical coupling is effected therebetween. Spring biased locking tabs 12 and 14 are provided within holder 6 for engaging slotted portions 16 and 18 of truck safety recorders 2 and 4, respectively, in order to releasably retain the truck safety recorders in their fully inserted positions. Holder 6 is in turn mounted to the vehicle by screws 20 at a location within convenient access of the drivers of the vehicle.

Truck safety recorders 2 and 4 are identical to one another, and accordingly, only truck safety recorder 2 is described in further detail below. Truck safety recorder 2 includes a keyed switch (144 in FIG. 4) into which a key 22 is inserted by the person driving the vehicle. The keyed switch within each truck safety recorder is adapted to receive only a particular key associated therewith. When the proper key is inserted within the keyed switch and rotated slightly, an electrical signal is generated in a manner described in further detail below for indicating that the key has been inserted.

For the convenience of the user, truck safety recorder 2 incorporates the features of an electronic chronograph with alarm of the type presently available in wristwatch form. Still referring to FIG. 1, truck safety recorder 2 includes three two-digit, seven-segment liquid crystal displays 24, 26 and 28 for displaying, in twenty four hour military fashion, the real time within the driver's home base time zone in hours, minutes, and seconds, respectively. Two-digit, seven-segment liquid crystal displays 30 and 32 indicate the current month and day, respectively. In addition, two-digit, seven-segment liquid crystal displays 34, 36 and 38 indicate hours, minutes, and seconds, respectively, corresponding to either real local time, elapsed stopwatch time, or alarm set time, as selected by the user.

In order to control home base time displays 24-32 and local time/stopwatch/alarm displays 34-38, three pushbutton type switches 40 (MODE), 42 (ALARM-/SELECT), and 44 (SET/START-STOP) are included within truck safety recorder 2. The manner in which pushbuttons 40, 42 and 44 are utilized to control displays 24–32 and 34–38 is described in further detail below with regard to FIG. 2.

Truck safety recorder 2 includes driving time displays 46 and 48, each of which is a two-digit, seven-segment light emitting diode-type display for displaying the hours and minutes, respectively, during which a driver has been driving the vehicle. Truck safety recorder 2 also includes accumulated on duty displays 50 and 52, on duty displays 54 and 56, and sleeper (off duty) displays 58 and 60, each of which is a two-digit, seven-segment light emitting diode-type display. Displays 50 and 52 indicate (in hours and minutes) the cumulative amount of time that a driver has been on duty over a period of days or other time intervals. Displays 54 and 56 indicate (in hours and minutes, respectively) the amount of time that a driver has been on duty since his last eight consecutive hour off duty period. Displays 58 and 60 indicate (in hours and minutes, respectively) the amount of time that a driver has spent off duty. Switch 62 is included within truck safety recorder 2 and has a first position (OD) and a second position (SL) in order for the driver to indicate whether he is on duty or sleeping, respectively. Truck safety recorder 2 also includes a switch 64 which may be rotated between a first position (60/7) and a second position (70/8) in order for the driver to indicate whether he works on a seven day schedule (on duty time accumulated for seven days) or a daily schedule (on duty time accumulated for eight days), respectively. As mentioned above, federal motor carrier safety regulations state that a driver should not accumulate more than 60 hours on duty within a seven consecutive day period nor accumulate more than 70 hours on duty within an eight consecutive day period. Accordingly, drivers who work on a weekly schedule set switch 64 to the 60/7 position while drivers who operate on a daily basis set switch 64 to the 70/8 position. Switch 64 has a slotted shaft which may be engaged by the tip of a screwdriver or the edge of a coin in order to change switch positions.

If a truck is stopped on the highway by federal authorities seeking to determine whether the driver or drivers of the vehicle have complied with federal motor carrier safety regulations, the driver or drivers simply insert their respective truck safety recorders into holder 6 in order to illuminate the displays indicating driving time, accumulated on duty time, on duty time and sleeping time. Federal authorities can then observe the displays and quickly determine whether or not the driver or drivers are in compliance with safety regulations.

Figure 2:
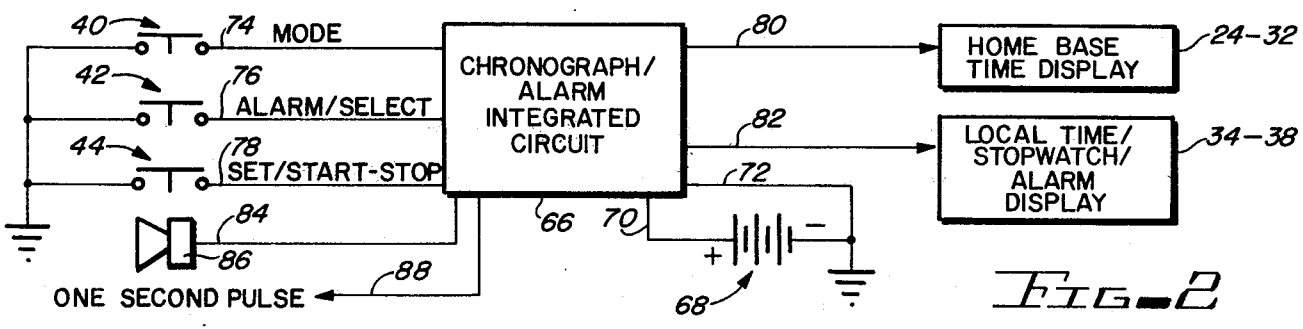
FIG. 2 is a block diagram of clock subsystem circuitry associated with the chronograph and alarm features of each of the truck safety recorders.

In FIG. 2, the clock subsystem within each truck safety recorder is shown in block diagram form. The clock subsystem includes an integrated circuit chip 66 of the general type utilized within chronograph/alarm wristwatches commercially available from Texas Instruments Incorporated and other semiconductor manufacturers. Such integrated circuits typically utilize CMOS transistor circuitry and therefore consume very little power. Integrated circuit 66 is powered by battery 68, the positive terminal and grounded negative terminal of which are coupled by lines 70 and 72 to positive voltage supply and ground terminals, respectively, of integrated circuit 66. Battery 68 is a small, low voltage battery of the type conventionally utilized with chronograph/alarm wristwatches. Switches 40, 42, and 44 each have a first terminal coupled to integrated circuit 66 by lines 74, 76 and 78, respectively. The second terminal of switches 40, 42 and 44 is each coupled to ground whereby lines 74, 76 and 78 are grounded whenever the corresponding switch is depressed.

Integrated circuit 66 is coupled by a plurality of lines designated 80 to the home base time displays 24, 26, 28, 30 and 32 shown in FIG. 1 for indicating the home base time, month, and day. Integrated circuit 66 is also coupled by a plurality of lines designated 82 to local time/-stopwatch/alarm displays 34, 36 and 38 shown in FIG. 1 for displaying either local time, elapsed stopwatch time, or the time at which the alarm is to be actuated. Since displays 24–38 are of the liquid crystal type, they consume little power and are driven by battery 68. Integrated circuit 66 is also coupled by line 84 to an audio alarm 86 of the type typically utilized within chronograph/alarm wristwatches. Integrated circuit 66 also generates a periodic time signal, which, in the preferred embodiment, pulses once per second. This periodic time signal is conducted by line 88 to other portions of the truck safety recorder circuitry to be described below.

Switches 40, 42 and 44 are used to set the home base time (including month and day), to set the local time, to set the time at which alarm 86 is actuated, to start, stop and reset the stopwatch function, and to select the information that is displayed by displays 34, 36 and 38. The MODE switch 40 is used to advance the clock subsystem through the following functions, advancing one function each time it is pushed:

a. alarm set;
b. stopwatch display;
c. local time zone set;
d. home base time/month/day set; and
e. local time zone and home base time display.

When the clock subsystem is in modes c or d, the particular digit to be set (hours, minutes, seconds, month, day) will blink. Depressing SET/START-STOP pushbutton 44 causes the blinking digit to increment at a one second rate. When the appropriate digit appears in the display, pushbutton 44 is released. Thereafter, depressing ALARM/SELECT pushbutton 42 causes the next successive digit to blink, and pushbutton 44 is again depressed to advance the display to the desired number. This process is repeated until each of the digits is properly set. Depressing pushbutton 40 following any set operation returns the clock subsystem to normal mode e for displaying local time and home base time.

When in mode a, the digits displayed by displays 34, 36 and 38 are set in a manner similar to the manner in which local time and home base time are set in modes c and d in order to select the particular local time at which the alarm 86 is actuated. Depressing ALARM-/SELECT pushbutton 42 when in mode e alternately arms or disarms the alarm.

When in mode b, depressing the SET/START-STOP button 44 will alternately start or stop the stopwatch function, and the elapsed stopwatch time will appear in displays 34, 36 and 38. Depressing pushbutton 42 while the stopwatch elapsed time has been stopped causes the elapsed stopwatch time to be reset to zero.

Figure 3:
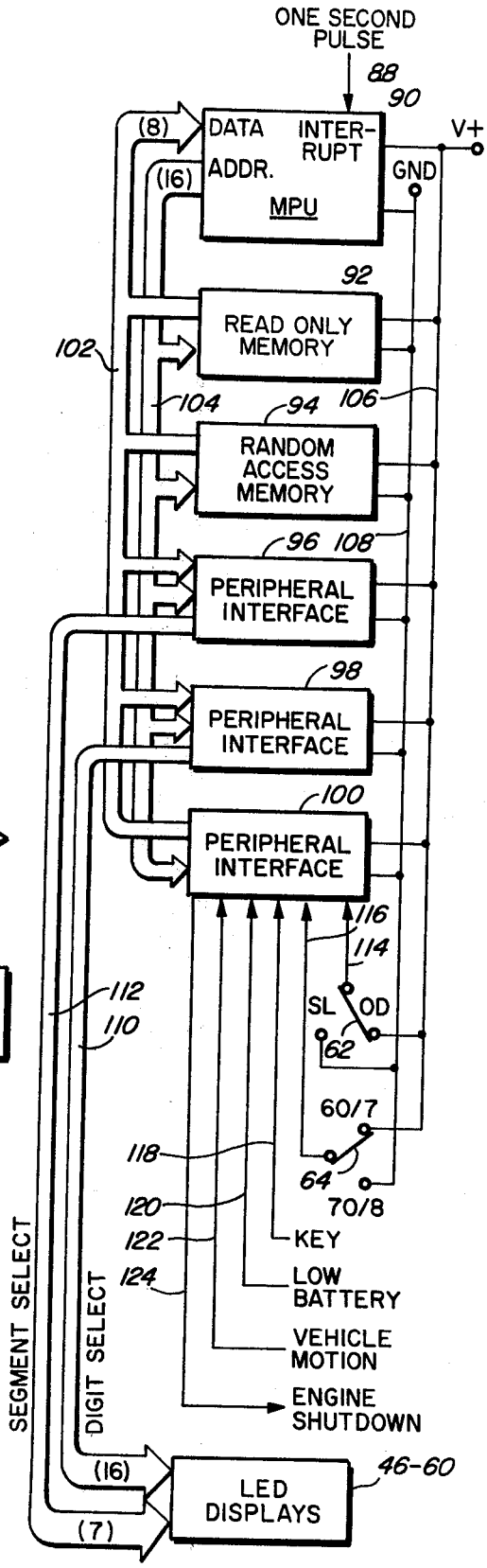
FIG. 3 is a block diagram of the control, storage, interface, and display components of each of the truck safety recorders shown in FIG. 1.

FIG. 3 illustrates the microprocessor subsystem within each truck safety recorder. The microprocessor subsystem includes a microprocessing unit (MPU) 90, a read only memory (ROM) 92, a random acess memory (RAM) 94, and a plurality of peripheral interface units 96, 98 and 100. In the preferred embodiment of the invention, MPU 90 is part type CDP 1082, ROM 92 is part type CDP 1846, RAM 94 is part type CDP 1831, and peripheral interface units 96, 98 and 100 are each part types CDP 1852, all of which are CMOS integrated circuits commercially available from Radio Corporation of America. Each of these devices is adapted to receive and/or transmit an eight-bit data word, and an eight-bit common data bus 102 couples the respective data ports of each of these devices so that data may be interchanged therebetween. A sixteen-bit address bus 104 is driven by an address output port of MPU 90 and is coupled to an address port of ROM 92 and RAM 94 for addressing particular storage locations therein. Address bus 104 is also coupled to the address ports of peripheral interface units 96, 98 and 100 in order to address these units for exchanging data therewith.

Each of devices 90–100 includes a positive supply voltage terminal coupled to conductor 106 for receiving a positive supply voltage. In addition, each of devices 90–100 includes a ground terminal coupled to ground line 108. A master clock signal is typically coupled by a clocking line (not shown) to each of components 90–100 in order to synchronize the operation of the various components with one another.

MPU 90 executes a plurality of instructions stored within ROM 92. Two basic sets of instructions are stored within ROM 92 comprising a main program and an interrupt subroutine to be described in further detail below. MPU 90 is coupled to conductor 88 for receiving the periodic one second pulse provided by the clock subsystem. Conductor 88 is coupled to an interrupt input of MPU 90 for causing MPU 90 to temporarily halt execution of the main program and execute the interrupt subroutine each time the one second pulse occurs. Following execution of the interrupt subroutine, control is returned to the main program. RAM 94 provides a plurality of storage locations which are used to store driving time, on duty time, accumulated on duty time, sleeping time and one or more program flags. An additional eight storage locations within RAM 94 are used to store individual on duty times for the eight most recent twenty-four hour periods, from which the accumulated on duty time is computed.

Peripheral interface units 96 and 98 are utilized to control light emitting diode displays 46–48, 50–52, 54–56 and 58–60. Displays 46–60 include a total of sixteen seven-segment displays, and peripheral interface unit 98 drives sixteen lines designated 110 in order to select one of the sixteen digits within displays 46–60. Peripheral unit 96 drives seven lines designated 112 coupled to displays 46–60 for indicating which of the seven segments within the selected digit are to be illuminated. Only one digit is illuminated at any given moment, but the digits are scanned at a relatively high frequency so that they appear to be illuminated simultaneously. Light emitting diode displays 46–60 are continuously scanned by MPU 90 during execution of the main program loop.

Peripheral interface unit 100 serves as a general interface between the microprocessor subsystem and the input devices coupled thereto. On duty/sleeper switch 62 is coupled by line 114 to a first input terminal of peripheral interface unit 100. As shown in FIG. 3, line 114 is a positive voltage when switch 62 is in the on duty (OD) position; conversely, line 114 is at ground potential when switch 62 is in the off duty or sleeper (SL) position. Similarly, switch 64 is coupled by line 116 to a second input terminal of peripheral interface unit 100 in order to indicate whether the accumulated on duty time is to be computed for seven consecutive days, in which case line 116 is a positive voltage, or for eight consecutive days, in which case line 116 is at ground potential, Line 118 is coupled to a third input of peripheral interface unit 100 for indicating whether or not the driver has inserted his key within the truck safety recorder.

Line 120 is coupled to a fourth input of peripheral interface unit 100 for indicating a low battery voltage condition which causes MPU 90 to blank light emitting diode displays 46–60 in order to reduce power consumption. Blanking of the displays may be accomplished by actuating a blanking input within the display control circuitry via a blanking control line (not shown) coupled between the blanking input and peripheral interface unit 96. Alternatively, blanking may be accomplished simply by forcing all sixteen digit select lines 110 to an inactive state so that none of the digits is selected during display scanning.

Line 122 is coupled to a fifth input to peripheral interface unit 100 for coupling a vehicle motion signal to the microprocessor subsystem. As is explained in further detail below, vehicle motion signal 122 is generated by a sensor mounted to the vehicle proximate the drive shaft for sensing rotation thereof. With a single transfer of data from peripheral interface unit 100 to MPU 90, the binary status of each of the input lines 114–122 is accessed. As will be described below, the binary status of the various input lines 114–122 may be used to control the sequence of instructions executed by MPU 90.

Peripheral interface unit 100 also includes an output terminal coupled to output line 124 for providing an engine shutdown signal. MPU 90 generates the engine shutdown signal whenever the driver has inserted his key within the keyed switch, as indicated by the signal conducted by line 118, while switch 62 is set at the sleeper of off duty position, as indicated by the signal conducted by line 114. The purpose of the engine shutdown signal is to prevent the driver from driving the vehicle without first switching his on duty/sleeper switch 62 to the on duty position.

Figure 4:
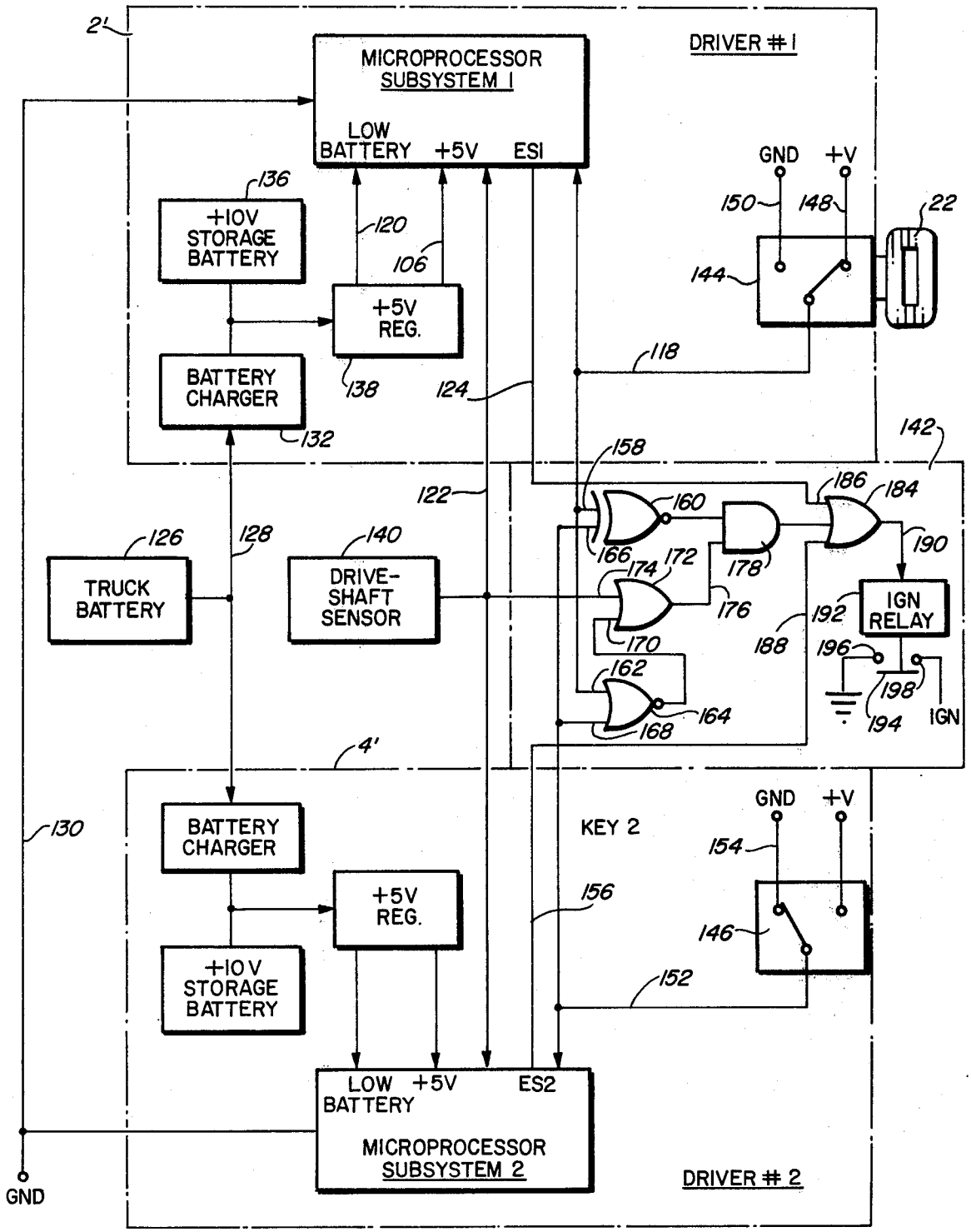
FIG. 4 is a block diagram illustrating the electrical interface between the pair of truck safety recorders and the vehicle mounted holder shown in FIG. 1.
Figure 9:
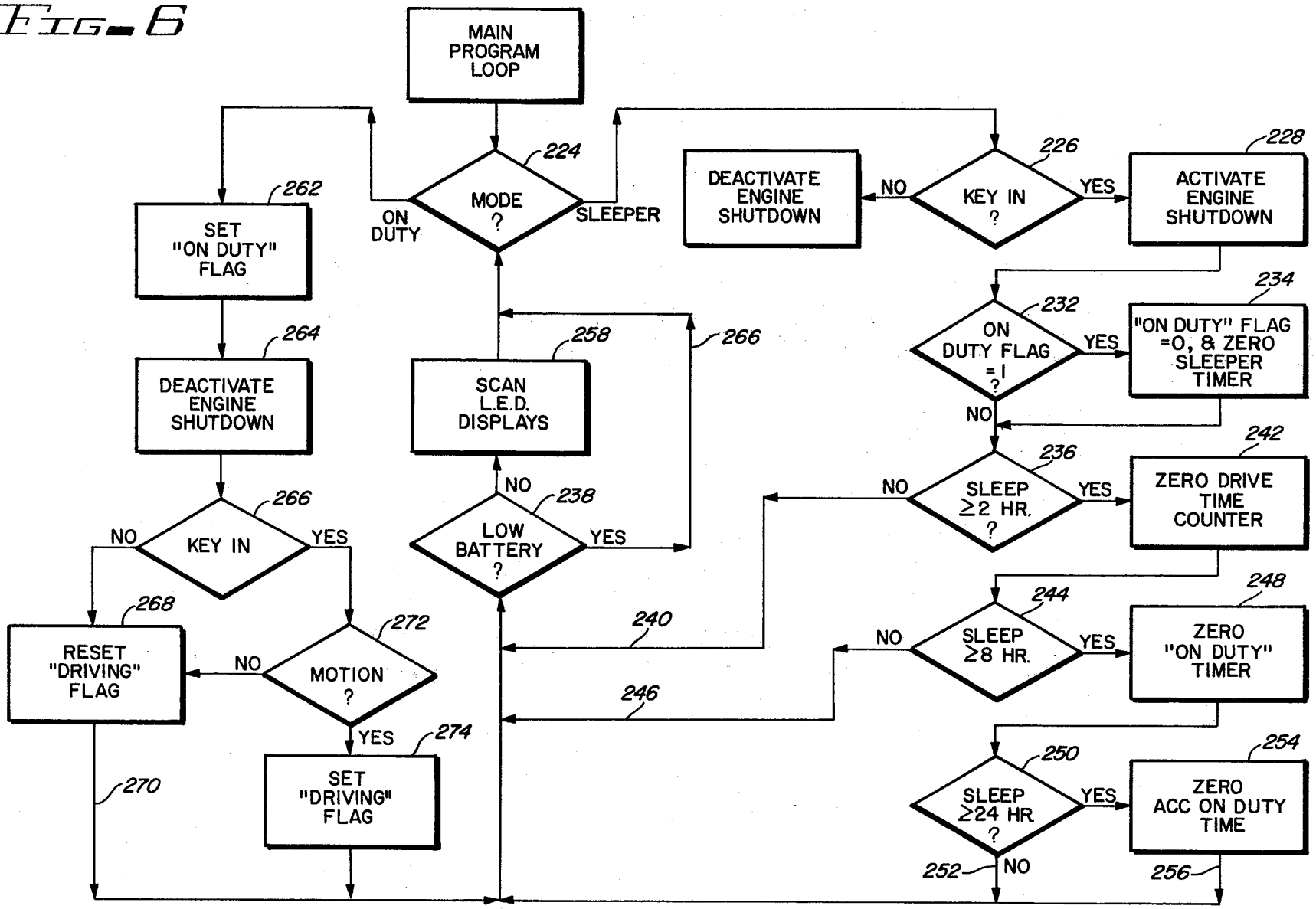

In FIG. 4, the interface between each of the truck safety recorders and the vehicle is shown in greater detail. Within FIG. 4, dashed block 2' indicates circuitry within truck safety recorder 2 and dashed block 4' indicates circuitry within truck safety recorder 4. The positive terminal of truck battery 126 is coupled to truck safety recorders 2' and 4' by line 128. Similarly, the truck chassis ground is coupled to each of the truck safety recorders by ground line 130. As described above with reference to FIG. 1, interconnection of lines 128 and 130 to each of the truck safety recorders is by means of a plurality of electrical connector pins 8 which removably engage a corresponding plurality of sockets within an end portion 10 of each of the truck safety recorders.

Assuming that truck safety recorder 2 is fully inserted within holder 6 as shown in FIG. 1, then line 128 is electrically coupled to a battery charger circuit 132 which receives a positive voltage from the truck battery of approximately 12.6 to 15 volts. The output of battery charger circuit 132 is coupled by conductor 134 to a rechargeable +10 volt storage battery 136 for supplying a charging voltage thereto. Conductor 134 is also coupled to the input of a voltage regulator circuit 138 which supplies a regulated positive 5 volts to positive supply voltage conductor 108 (see FIG. 3). In addition, regulator circuit 138 provides an output signal to line 120 (see FIG. 3) for indicating that the output voltage of storage battery 136 is low (e.g., below eight volts), and that power consumption by the microprocessor subsystem should therefore be reduced. By way of example, the low battery voltage signal may normally be +5 volts when storage battery 136 is sufficiently charged while dropping to approximately ground potential when storage battery 136 needs to be recharged.

As indicated in FIG. 4, the truck or other vehicle is equipped with a drive shaft sensor 140 for detecting rotation of the drive shaft and hence, motion of the vehicle. By way of example only, the sensor may include an inductive coil which senses the proximity of a magnetic member affixed to the rotating drive shaft. Drive shaft sensor 140 may also include circuitry of the type known to those skilled in the art for converting the pulsations created by rotation of the drive shaft to a steady state signal indicating that the drive shaft is being rotated. For example, the electrical pulsations resulting from rotation of the drive shaft may be suitably buffered and thereafter supplied to the trigger input of a retriggerable one-shot circuit for generating a steady state positive output voltage signal (logic "1") when the vehicle is in motion while providing an output signal essentially at ground potential (logic "0") when the vehicle is not in motion. Conductor 122 couples the output of drive shaft sensor circuit 140 to each of the truck safety recorders for providing a vehicle motion signal thereto. In addition, conductor 122 is coupled to an engine enable/disable circuit shown within dashed block 142, the function of which will be described in further detail below.

As shown in FIG. 4, truck safety recorder 2 includes a keyed switch 144 operated by a corresponding key 22. Truck safety recorder 4 includes a similar keyed switch 146 operated by a corresponding key (not shown). Keyed switch 144 receives a positive 5 volt level on line 148 and ground potential on line 150. Conductor 118 is coupled to the output terminal of keyed switch 144 to conduct a signal (KEY1) for indicating whether or not key 22 is inserted within keyed switch 144. As shown in FIG. 4, when key 22 is inserted within keyed switch 144 for rotating the lock cylinder therein, the switch makes contact with line 148 for coupling line 118 to the positive 5 volt supply. However, when key 22 is removed from keyed switch 144, line 118 is coupled to line 150 and hence, to ground potential. Keyed switch 146 within truck safety recorder 4 couples KEY2 line 152 to ground potential line 154 since the corresponding key has been removed from keyed switch 146.

As explained above, the microprocessor subsystem within each truck safety recorder is responsive to the corresponding key insert signal (KEY1, KEY2, etc.) and to the position of the on duty/sleeper switch 62 (see FIG. 3) for generating an engine shutdown signal. The engine shutdown signal generated by truck safety recorder 2 (ES1) is coupled by conductor 124 to enable/-disable circuit 142. Similarly, the microprocessor subsystem within truck safety recorder 4 generates an engine shutdown signal (ES2) which is coupled by conductor 156 to engine enable/disable circuit 142.

Engine enable/disable circuit 142 may be located within holder 6 (see FIG. 1) or at any other convenient location within the vehicle. The purpose of engine enable/disable circuit 142 is to prevent operation of the vehicle under certain specified circumstances. If the microprocessor subsystem within either of truck safety recorders 2 or 4 generates an engine shutdown signal, i.e., ES1 or ES2 is a positive voltage or a logic "1", then the engine is disabled to compel the driver either to change his on duty/sleeper switch for indicating that he is on duty or else to remove his key. Another purpose of engine enable/disable circuit 142 is to ensure that the driver has inserted his truck safety recorder into holder 6 and has inserted his key within the keyed switch of the truck safety recorder. Thus, the driver of the vehicle can not operate the vehicle without inserting his truck safety recorder and its corresponding key into holder 6; consequently, the driver can not operate the truck without simultaneously incrementing the driving time stored and displayed by his truck safety recorder.

Engine enable/disable circuit 142 also disables the engine of the vehicle if both drivers have their keys inserted within their respective truck safety recorders while the vehicle is in motion. This provision prevents the condition wherein both the truck safety recorders simultaneously increment driving time when one of the operators of the vehicle has inadvertently forgotten to remove his key from his truck safety recorder, as might happen when the pair of drivers alternate positions behind the sterring wheel. However, those skilled in the art will realize that engine enable/disable circuit 142 does not interfere with the normal procedure of changing drivers. When the drivers are to change positions behind the steering wheel, the vehicle has come to a full stop, and accordingly, the vehicle motion signal generated by the drive shaft sensor is inactive even though the engine is running. The drivers then exchange positions, and the new driver inserts his key into his corresponding truck safety recorder while the previous driver removes his key from his corresponding truck safety recorder before the vehicle is again set in motion.

Referring now in detail to enable/disable circuitry 142, conductor 118 couples the KEY1 signal to input 158 of exclusive NOR gate 160 and to input 162 of NOR gate 164. Similarly, conductor 152 couples the KEY2 signal to input 166 of gate 160 and to input 168 of gate 164. As is known to those skilled in the art, the output of exclusive NOR gate 160 is a positive voltage or logic "1" provided that either the KEY1 and KEY2 signals are both a logic "1" or provided that the KEY1 and KEY2 signals are both logic "zero"; if one but not both of the KEY1 and KEY2 signals is a logic "1", then the output of gate 160 is a logic "zero". The output of NOR gate 164 is a logic "zero" unless both the KEY1 signal and the KEY2 signal are logic "zero".

The output of NOR gate 164 is coupled to input 170 of OR gate 172. Second input 174 of OR gate 172 is coupled to conductor 122 for receiving the vehicle motion signal from drive shaft sensor circuitry 140. The output of OR gate 172 is a logic "1" whenever either or both of its inputs 170 and 174 is at a logic "1". The output of OR gate 172 is coupled to a first input 176 of AND gate 178. The second input 180 of AND gate 178 is coupled to the output of exclusive NOR gate 160. The output of AND gate 178 is a logic "1" only when its inputs 176 and 180 are both a logic "1".

The output of AND gate 178 is coupled to a first input 182 of OR gate 184. A second input 186 of OR gate 184 is coupled to line 124 for receiving the ES1 signal. A third input 188 of OR gate 184 is coupled to line 156 for receiving the ES2 signal. The output of OR gate 184 is a logic "1" whenever any one or more of its inputs 182, 186, or 188 is a logic "1". The output of OR gate 184 is coupled by line 190 to an ignition relay coil 192 for controlling relay contact 194. When line 190 is a logic "1" or positive voltage, ignition relay coil is energized for pulling switch contact 194 against terminals 196 and 198, thereby grounding the ignition system of the vehicle and disabling the engine.

The Boolean logic expression for the logic level on line 190 may be stated in the following manner:

$$ES1+ES2+[\overline{KEY1\cdot KEY2})+(KEY1\cdot KEY2)]\cdot[MOTION+(\overline{KEY1+KEY2})]$$

Simplification of the above Boolean logic expression results in the following:

$$ES1+ES2+(MOTION \cdot KEY1 \cdot KEY2)+\overline{(KEY1 \cdot KEY2)}$$

From the above expression, those skilled in the art will realize that the vehicle ignition system will be grounded whenever:

a. ES1 is a logic "1"; or
b. ES2 is a logic "1"; or
c. The vehicle is in motion and both drivers have inserted their keys within their truck safety recorders; or
d. neither driver has inserted his key within his corresponding truck safety recorder.

If none of the above conditions is true, then the engine may be started via a separate dashboard mounted starter switch (not shown) within the vehicle.

Figure 5:
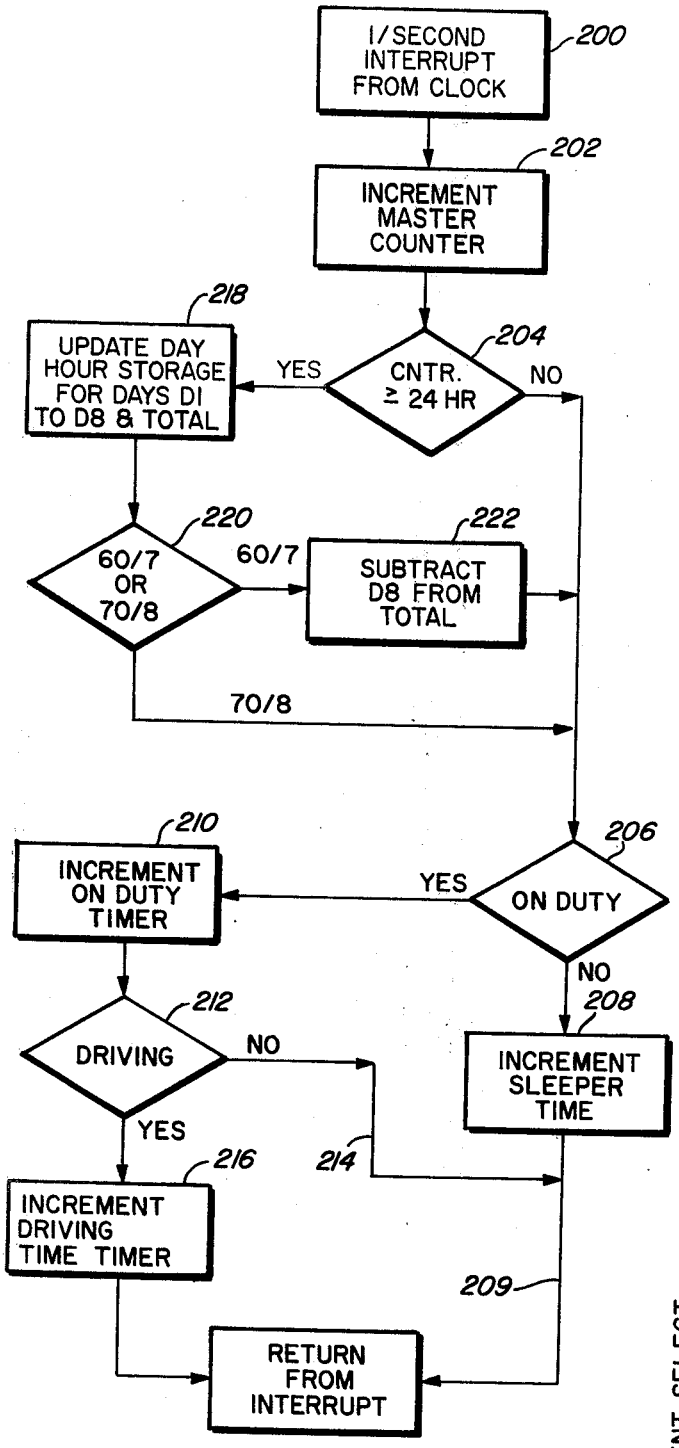
FIG. 5 is a flow chart diagram of the interrupt software sequence implemented by the microprocessor control circuit each time a periodic time signal is generated by the clock subsystem.

Referring now to FIG. 5, the flow chart illustrated therein summarizes the series of instructions stored within ROM 92 (see FIG. 3) which are executed by MPU 90 each time an interrupt is generated by the occurrence of the one second pulse coupled to MPU 90 by line 88. Within FIG. 5, the occurrence of the interrupt is represented by box 200. The first step in the subroutine sequence is represented by box 202 which corresponds to incrementing a master counter. The master counter consists of a plurality of storage locations within RAM 94 which together form a storage location of sufficient bit length to store the decimal number 86,400 (60 seconds per minute times 60 minutes per hour times 24 hours per day). The master counter is incremented by one each time an interrupt is generated. After incrementing the master counter, the subroutine performs a test represented by diamond shaped box 204 in order to determine whether the master counter has reached decimal 86,400, indicating that a twenty four hour time interval has passed.

Assuming that a twenty four hour interval has not passed, the subroutine proceeds directly to diamond shaped box 206. Assuming that switch 62 is in the sleeper or off duty position, then a binary valued "on duty" flag will have been reset by the main program, and the subroutine branches to box 208 for incrementing sleeper time. Sleeper time is stored in a series of three 8-bit storage locations within RAM 94. Two of the 8-bit storage locations are used to store four binary coded decimal digits corresponding to the hours and minutes displayed by light emitting diode displays 58 and 60 (see FIG. 1). The third eight-bit storage location is used to count seconds, and each time the seconds counter reaches sixty, it is reset and the four binary coded decimal digits are incremented to indicate an additional minute of sleeping time. Following execution of the instructions corresponding to box 208, MPU 90 returns control to the main program stored within ROM 92 as shown by arrow 209.

Referring again to diamond shaped box 206, if switch 62 indicates that the driver is on duty, the the "on duty" flag will have been set by the main program, and the subroutine branches to a series of instructions represented by box 210. At this point, a pair of on duty timers are incremented, each on duty timer being formed by a series of three eight-bit storage locations within RAM 94 in a similar fashion to that used to store sleeper time. The first of the pair of on duty timers correspond to the on duty time displayed by displays 54 and 56 (see FIG. 1) and is therefore designated the displayed on duty timer. The second of the on duty timers is utilized to store on duty time within each twenty four interval in order to accumulate on duty time in a manner to be described below and is therefore designated the interval on duty timer. The displayed and interval on duty timers are incremented in a manner identical to that described above with regard to the sleeper timer.

After incrementing the displayed and interval on duty timers, the subroutine proceeds to diamond shaped box 212 where it is determined whether or not the corresponding driver is actually driving the vehicle. This determination is made based upon the status of a binary valued "driving" flag controlled by the main program. Assuming that either the key insert signal or the vehicle in motion signal is inactive, then the "driving" flag will have been reset by the main program since the driver is not actually driving the vehicle, and control is returned to the main program as shown by arrow 214 in FIG. 5. On the other hand, if both the key insert signal and the vehicle in motion signal are active, then the "driving" flag will have been set by the main program, and the subroutine proceeds to box 216 for incrementing the driving time timer. As in the case of the sleeper timer and the on duty timers, the driving time timer consists of a series of three eight-bit storage locations within RAM 94. Two of the eight-bit storage locations form four binary coded decimal digits corresponding to the hours and minutes displayed by displays 46 and 48 (see FIG. 1). The third storage location counts seconds in the manner already described. After incrementing the driving time timer, control is returned to the main program.

Referring again to diamond shaped box 204, assuming that the master counter indicates that a twenty four hour time interval has elapsed, then the subroutine proceeds to a series of instructions represented by box 218. This sequence of instructions first causes the master counter to be reset to zero in order to initialize the master counter for timing the next twenty four hour time interval. Following initialization of the master counter, instructions are executed for updating the accumulated on duty time. In order to accumulate on duty time over a period of as many as eight days, eight storage registers are formed within RAM 94, each storage register including a pair of eight-bit storage locations forming four binary coded decimal digits corresponding to hours and minutes of on duty time for the eight most recent twenty four hour intervals. At the passage of each twenty four hour time interval, the contents of the seventh storage register are transferred to the eighth storage register, the contents of the sixth storage register are transferred to the seventh storage register, and so forth. Subsequently, the contents of the interval on duty timer is transferred to the first of the eight storage registers. The interval on duty timer is then reset to zero in order to be initialized for the next twenty four hour time interval.

MPU 90 then totals the hours and minutes stored by the eight storage registers for accumulating the on duty time for the eight most recent twenty four hour intervals. The subroutine then proceeds to diamond shaped box 220 at which point it is determined whether the accumulated on duty time should reflect the seven most recent days or the eight most recent days. In order to make this determination, MPU 90 accesses peripheral interface unit 100 for determining the status of switch 64 (see FIG. 3).

If the accumulated on duty time is to reflect only the most recent seven days, then the subroutine proceeds to box 222 for causing MPU 90 to subtract the contents of the eighth storage register from the previously computed total of the eight storage registers. The corrected total of accumulated on duty time is then stored in a pair of eight bit storage locations within RAM 94 in four digit binary coded decimal form corresponding to the hours and minutes displayed by displays 50 and 52. The subroutine then proceeds to diamond shaped box 206 described above.

On the other hand, if, within diamond shaped box 220, it is determined that the accumulated on duty time should be computed on an eight day basis, then the total of the eight storage registers computed within box 218 is stored directly within the accumulated on duty storage locations within RAM 94 without subtracting the contents of the eighth storage register therefrom, and the subroutine then proceeds to diamond shaped box 206.

The main program loop executed by MPU 90 is shown in FIG. 6. Diamond shaped box 224 is the beginning of the main program loop and corresponds to the step of determining whether the driver is on duty or off duty. In order to make this determination, MPU 90 accesses peripheral interface unit 100 for determining the status of on duty/sleeper switch 62 as well as the status of the other input signals coupled thereto. Assuming first that switch 62 indicates that the corresponding driver is off duty or sleeping, the program proceeds to diamond shaped box 226 for determining whether the corresponding driver has inserted his key within the keyed switch as indicated by the key insert signal coupled to peripheral interface unit 100. If the key is inserted, then the subroutine proceeds to box 228 for activating the engine shutdown signal. On the other hand, if the key is not inserted, then the program proceeds to box 230 for deactivating the engine shutdown signal. MPU 90 activates or deactivates the engine shutdown signal by writing a logic "1" or logic "zero", respectively, to peripheral interface unit 100 which, in turn, couples the engine shutdown signal to line 124 (see FIG. 3).

The program proceeds from either box 228 or box 230 to diamond shaped box 232. At this point, the program determines whether the driver has altered his on duty/sleeper switch 26 since the last time that this portion of the main program was executed. A binary valued "on duty" flag is used to make this determination; the "on duty" flag is also utilized by the interrupt subroutine described above. Assuming that the driver previously had his switch 62 set at the on duty position, then the "on duty" flag will have previously been set to a logic "1" in a manner described below. If the "on duty" flag is equal to logic "1" when the portion of the main program corresponding to diamond shaped box 232 is executed, then the "on duty" flag is reset to logic "zero", and the storage locations within RAM 94 used to form the sleeper timer are reset to zero. The program then proceeds to diamond shaped box 236. Referring again to diamond shaped box 232, if the "on duty" flag is already equal to logic "zero", then the program proceeds directly to diamond shaped box 236 without resetting the sleeper timer. Thus, the sleeper timer is reset each time the driver changes his status from on duty to off duty.

Diamond shaped box 236 corresponds to a series of instructions which determine whether the value stored by the sleeper timer is greater than or equal to two hours; if not, then program control proceeds to diamond shaped box 238 as indicated by arrow 240. If the sleeper timer indicates that the driver has been sleeping for two hours or more, then the program proceeds to box 242 for resetting the drive time counter to zero since the driver has slept for the federally mandated two-hour minimum time between periods of driving.

From box 242, the program proceeds to diamond shaped box 244 for determining whether the sleeper timer indicates that the driver has been sleeping for eight hours or more; if not, then program control proceeds to diamond shaped box 238 as indicated by arrow 246. However, if the driver has slept continuously for eight hours or more, program control proceeds to box 248, and the displayed on duty timer is reset to zero since the driver has then complied with the federally mandated eight-hour minimum off duty time between successive on duty periods.

After the displayed on duty time has been reset via box 248, the main program proceeds to diamond shaped box 250 for determining whether the sleeper timer indicates that the driver has been off duty continuously for twenty four hours or more; if not, program control proceeds to diamond shaped box 238 as indicated by arrow 252. However, if the sleeper timer indicates that the driver has been off duty continuously for twenty four hours or more, then program control proceeds to box 254 for resetting the accumulated on duty time, i.e., the storage locations displayed by displays 50 and 52, since the driver has then broken the chain of consecutive days on duty by taking a full day off duty as required by federal regulations. In addition to resetting the storage locations containing the accumulated on duty time, the eight storage registers used to store the on duty time for the eight most recent days are also reset in order to reflect the beginning of a new period over which accumulated on duty time is to be computed. Program control then proceeds to diamond shaped box 238 as shown by arrow 256.

Still referring to FIG. 6, diamond shaped box 238 corresponds to a branch point in the main program where it is determined whether or not the truck safety recorder rechargeable storage battery 136 (see FIG. 4) is sufficiently charged to drive the light emitting diode displays. If peripheral interface unit 100 indicates to MPU 90 that the low battery signal received on conductor 120 (see FIG. 3) is a positive voltage or logic "1", then the storage battery is sufficiently charged, and program control proceeds to box 258 which corresponds to a series of instructions for scanning each of the sixteen seven-segment digits within light emitting diode displays 46–60. Program control then proceeds to diamond shaped box 224. On the other hand, if the low battery signal received by conductor 120 is at ground potential or logic "0", then program control bypasses box 258 and proceeds directly to diamond shaped box 224 as shown by arrow 260 in order to conserve power by blanking the light emitting diode displays.

Referring again to diamond shaped box 224, if it is determined that the driver is on duty rather than off duty, then program control proceeds to box 262 at which point the "on duty" flag, mentioned above with reference to diamond shaped box 232, is set to logic "1". Program control then proceeds to box 264 in order to deactivate the engine shutdown signal. Thus, if the driver inadvertently has his on duty/sleeper switch 62 set to the sleeper (SL) position after inserting his key, the driver can enable the engine by simply changing switch 62 to the on duty (OD) position.

From box 264, program control proceeds to diamond shaped box 266 in order to determine whether the driver has his key inserted within his truck safety recorder; if not, then program control proceeds to box 268 for resetting a binary valued "driving" flag used by the interrupt subroutine for determining whether the driving timer is to be incremented. Program control proceeds from box 268 to diamond shaped box 238 as shown by arrow 270. On the other hand, if the driver has inserted his key, then program control proceeds from diamond shaped box 266 to diamond shaped box 272. If the vehicle motion signal received on line 122 of peripheral interface unit 100 is a logic "zero", then the vehicle is not in motion and program control proceeds to box 268 for resetting the "driving" flag as mentioned above. However, if the vehicle motion signal is a logic "1", then the "driving" flag is set to a logic "1", as indicated by box 274. Program control proceeds from box 274 to diamond shaped box 238, the function of which is described above.

Those skilled in the art will now appreciate that a recording apparatus has been described which eliminates the need to keep daily written logs of driving time, on duty time, accumulated on duty time, and sleeping time, while preserving such information for inspection by federal authorities. The information recorded and displayed by the disclosed recording apparatus may not be altered by drivers wishing to avoid compliance with federal motor carrier safety regulations and thereby compels drivers to comply with such regulations. The truck safety recorder may be carried on the person of the driver when the driver is not actually driving the vehicle, and the chronograph/alarm features of the truck safety recorder provide added convenience to the driver.

While the invention has been described with reference to a preferred embodiment thereof, the description is for illustrative purposes only and is not to be construed as limiting the scope of the invention. For example, although the preferred embodiment of the invention has been described assuming that a pair of drivers alternately operate the vehicle, it should be clear to those skilled in the art that the recording apparatus may be used equally as well for vehicles operated by a single driver in which case, only one truck safety recorder is needed. Various other modifications and changes may be made by those skilled in the art without departing from the true spirit and scope of the invention as defined by the appended claims.

I claim:

1. A recording apparatus for use by a driver of a vehicle, the vehicle powered by an engine, said recording apparatus comprising in combination:

a. clocking means for generating a periodic time signal;

b. a sensor for sensing that the vehicle is in motion and generating a motion signal in response thereto;

c. first storage means for storing the amount of time that the driver has spent driving the vehicle;

d. display means coupled to said first storage means for displaying the time stored by said first storage means;

e. control means responsive to the periodic time signal and responsive to the motion signal for incrementing the time stored by said first storage means upon an occurrence of said periodic time signal provided that the vehicle is in motion;

f. second storage means coupled to said control means for storing the amount of time that the driver has spent on duty;

g. third storage means coupled to said control means for storing the amount of time that the driver has spent off duty;

h. switch means coupled to said control means and operated by the driver for indicating whether the driver is on duty or off duty;

i. said control means incrementing said second storage means upon an occurrence of said periodic time signal provided that the driver is on duty and incrementing said third storage means upon an occurrence of said periodic time signal provided that the driver is off duty;

j. a keyed switch coupled to said control means and operated by an insertable key;

k. engine enable/disable means coupled to the engine of the vehicle and having an input for disabling the engine upon receiving a shut-down signal at the input; and l. said control means being coupled to the input of said engine enable/disable means for supplying the shutdown signal provided that said key is inserted within said keyed switch when said switch means indicates that the driver is off duty.

2. A recording apparatus as recited in claim 1 wherein said engine enable/disable means is responsive to said keyed switch for disabling the engine unless the driver has inserted said key within said keyed switch.

3. A recording apparatus for use by a driver of a vehicle, the vehicle being powered by an engine, said recording apparatus comprising in combination:

a. clocking means for generating a periodic time signal;

b. a sensor for sensing that the vehicle is in motion and generating a motion signal in response thereto;

c. first storage means for storing the amount of time that the driver has spent driving the vehicle;

d. display means coupled to said first storage means for displaying the time stored by said first storage means;

e. control means responsive to the periodic time signal and responsive to the motion signal for incrementing the time stored by said first storage means upon an occurrence of said periodic time signal provided that the vehicle is in motion;

f. a second storage means coupled to said control means for storing the amount of time that the driver has spent on duty;

g. third storage means coupled to said control means for storing the amount of time that the driver has spent off duty;

h. switch means coupled to said control means and operated by the driver for indicating whether the driver is on duty or off duty;

i. said control means incrementing said second storage means upon an occurrence of said periodic time signal provided that the driver is on duty and incrementing said third storage means upon an occurrence of said periodic time signal provided that the driver is off duty; and j. said control means resetting said first storage means only after the off duty time stored by said third storage means has reached a predetermined value.

4. A recording apparatus for use by a driver of a vehicle, the vehicle being powered by an engine, said recording apparatus comprising in combination:

a. clocking means for generating a periodic time signal;

b. a sensor for sensing that the vehicle is in motion and generating a motion signal in response thereto, c. first storage means for storing the amount of time that the driver has spent driving the vehicle;

d. display means coupled to said first storage means for displaying the time stored by said first storage means;

e. control means responsive to the periodic time signal and responsive to the motion signal for incrementing the time stored by said first storage means upon an occurrence of said periodic time signal provided that the vehicle is in motion;

f. second storage means coupled to said control means for storing the amount of time that the driver has spent on duty;

g. third storage means coupled to said control means for storing the amount of time that the driver has spent off duty;

h. switch means coupled to said control means and operated by the driver for indicating whether the driver is on duty or off duty;

i. said control means incrementing said second storage means upon an occurrence of said periodic time signal provided that the driver is on duty and incrementing said third storage means upon an occurrence of said periodic time signal provided that the driver is off duty; and j. fourth storage means for accumulating the amount of time that the driver has spent on duty over a plurality of predetermined time intervals, and wherein said control means includes interval means for periodically indicating the passage of a predetermined time interval, said control means updating the contents of said fourth storage means to reflect the contents of said second storage means upon recognizing the passage of each predetermined time interval, and thereupon resetting the contents of said second storage means.

5. A recording apparatus as recited in claim 4 including a plurality N of storage means for storing the contents of said second storage means for the N most recent predetermined time intervals, said control means summing the contents of said plurality N of storage means upon recognizing the passage of each predetermined time interval and storing the sum in said fourth storage means for allowing the contents of said fourth storage means to accumulate the amount of time that the driver has spent on duty over the N most recent predetermined time intervals.

6. A recording apparatus as recited in claim 5 including a selector coupled to said control means for selecting a value for N from among a plurality of possible values.

7. A recording apparatus as recited in claim 4 wherein said control means resets the contents of said fourth storage means only after the off duty time stored by said third storage means has reached a predetermined value.

8. Recording apparatus for use by a plurality of drivers alternately driving a vehicle, the vehicle being powered by an engine, said recording apparatus comprising in combination:

a. clocking means for generating a periodic time signal;

b. a sensor for sensing that the vehicle is in motion and generating a motion signal in response thereto;

c. a plurality of first storage means corresponding to the plurality of drivers for storing the amount of time that each of the plurality of drivers has spent driving the vehicle;

d. a plurality of display means corresponding to the plurality of first storage means for displaying the time stored by each of said plurality of first storage means;

e. indicator means for indicating which of the plurality of drivers is driving the vehicle;

f. control means responsive to the periodic time signal, to the motion signal, and to the indicator means for incrementing the time stored by a particular one of said plurality of first storage means upon an occurrence of said periodic time signal provided that the vehicle is in motion, the particular one of said plurality of first storage means corresponding to the driver who is driving the vehicle;

g. said indicator means comprising a plurality of keyed switches corresponding to the plurality of drivers, each of said plurality of keyed switches being operated by a corresponding insertable key, each of said plurality of keyed switches generating a key insert signal whenever the corresponding key is inserted therein for indicating which of the plurality of drivers is driving the vehicle;

h. engine enable/disable means responsive to the key insert signals for enabling operation of the engine of the vehicle only if at least one of said plurality of keyed switches has a corresponding key inserted therein; and i. said engine enable/disable means being responsive to the motion signal, said engine enable/disable means disabling operation of the engine of the vehicle provided that the vehicle is in motion and more than one of said plurality of keyed switches has a corresponding key inserted therein.

9. Recording apparatus for use by a plurality of drivers alternately driving a vehicle, the vehicle being powered by an engine, said recording apparatus comprising:

a. clocking means for generating a periodic time signal;

b. a sensor for sensing that the vehicle is in motion and generating a motion signal in response thereto;

c. a plurality of first storage means corresponding to the plurality of drivers for storing the amount of time that each of the plurality of drivers has spent driving the vehicle;

d. a plurality of display means corresponding to the plurality of first storage means for displaying the time stored by each of said plurality of first storage means;

e. indicator means for indicating which of the plurality of drivers is driving the vehicle;

f. control means responsive to the periodic time signal, to the motion signal, and to the indicator means for incrementing the time stored by a particular one of said plurality of first storage means upon an occurrence of said periodic time signal provided that the vehicle is in motion, the particular one of said plurality of first storage means corresponding to the driver who is driving the vehicle;

g. a plurality of second storage means corresponding to the plurality of drivers and coupled to said control means, each of said plurality of second storage means storing the amount of time that the corresponding driver has spent on duty;

h. a plurality of third storage means corresponding to the plurality of drivers and coupled to said control means, each of said plurality of third storage means storing the amount of time that the corresponding driver has spent off duty;

i. a plurality of switch means corresponding to the plurality of drivers and coupled to said control means, each of said switch means being operated by the corresponding driver for indicating whether the corresponding driver is on duty or off duty;

j. said control means incrementing each of said second storage means upon an occurrence of said periodic time signal provided that the corresponding driver is on duty and incrementing each of said third storage means upon an occurrence of said periodic time signal provided that the corresponding driver is off duty; and k. said indicator means includes a plurality of keyed switches corresponding to the plurality of drivers and coupled to said control means, each of said plurality of keyed switches being operated by a corresponding insertable key; and wherein said recording apparatus further includes engine enable/disable means coupled to the engine of the vehicle and having input means for receiving a shutdown signal, said engine enable/disable means disabling the engine upon receiving a shutdown signal at said input means; said control means being coupled to said input means of said engine enable/-disable means for supplying a shutdown signal thereto provided that a key is inserted within a keyed switch corresponding to a particular driver when the switch means corresponding to the particular driver indicates that the particular driver is off duty.

10. Recording apparatus as recited in claim 9 wherein said engine enable/disable means is responsive to said plurality of keyed switches for disabling the engine of the vehicle unless at least one of said plurality of keyed switches has a corresponding key inserted therein.

11. Recording apparatus as recited in claim 10 wherein said engine enable/disable means is responsive to said motion signal for disabling the engine of the vehicle provided that the vehicle is in motion and more than one of said plurality of keyed switches has a corresponding key inserted therein.

12. Recording apparatus for use by a plurality of drivers alternately driving a vehicle, the vehicle being powered by an engine, said recording apparatus comprising in combination:

a. clocking means for generating a periodic time signal;

b. a sensor for sensing that the vehicle is in motion and generating a motion signal in response thereto;

c. a plurality of first storage means corresponding to the plurality of drivers for storing the amount of time that each of the plurality of drivers has spent driving the vehicle;

d. a plurality of display means corresponding to the plurality of first storage means for displaying the time stored by each of said plurality of first storage means;

e. indicator means for indicating which of the plurality of drivers is driving the vehicle;

f. control means responsive to the periodic time signal, to the motion signal, and to the indicator means for incrementing the time stored by a particular one of said plurality of first storage means upon an occurrence of said periodic time signal provided that the vehicle is in motion, the particular one of said plurality of first storage means corresponding to the driver who is driving the vehicle;

g. a plurality of second storage means corresponding to the plurality of drivers and coupled to said control means, each of said plurality of second storage means storing the amount of time that the corresponding driver has spent on duty;

h. a plurality of third storage means corresponding to the plurality of drivers and coupled to said control means, each of said plurality of third storage means storing the amount of time that the corresponding driver has spent off duty;

i. a plurality of switch means corresponding to the plurality of drivers and coupled to said control means, each of said switch means being operated by the corresponding driver for indicating whether the corresponding driver is on duty or off duty;

j. said control means incrementing each of said second storage means upon an occurrence of said periodic time signal provided that the corresponding driver is on duty and incrementing each of said third storage means upon an occurrence of said periodic time signal provided that the corresponding driver is off duty; and k. said control means resets one of said plurality of first storage means only after the off duty time stored by a corresponding one of said plurality of third storage means has reached a predetermined value.

13. Recording apparatus for use by a plurality of drivers alternately driving a vehicle, the vehicle being powered by an engine, said recording apparatus comprising in combination:

a. clocking means for generating a periodic time signal;

b. a sensor for sensing that the vehicle is in motion and generating a motion signal in response thereto;

c. a plurality of first storage means corresponding to the plurality of drivers for storing the amount of time that each of the plurality of drivers has spent driving the vehicle;

d. a plurality of display means corresponding to the plurality of first storage means for displaying the time stored by each of said plurality of first storage means;

e. indicator means for indicating which of the plurality of drivers is driving the vehicle;

f. control means responsive to the periodic time signal, to the motion signal, and to the indicator means for incrementing the time stored by a particular one of said plurality of first storage means upon an occurrence of said periodic time signal provided that the vehicle is in motion, the particular one of said plurality of first storage means corresponding to the driver who is driving the vehicle;

g. a plurality of second storage means corresponding to the plurality of drivers and coupled to said control means, each of said plurality of second storage means storing the amount of time that the corresponding driver has spent on duty;

h. a plurality of third storage means corresponding to the plurality of drivers and coupled to said control means, each of said plurality of third storage means storing the amount of time that the corresponding driver has spent off duty;

i. a plurality of switch means corresponding to the plurality of drivers and coupled to said control means, each of said switch means being operated by the corresponding driver for indicating whether the corresponding driver is on duty or off duty;

j. said control means incrementing each of said second storage means upon an occurrence of said periodic time signal provided that the corresponding driver is on duty and incrementing each of said third storage means upon an occurrence of said periodic time signal provided that the corresponding driver is off duty;

k. a plurality of fourth storage means corresponding to the plurality of drivers for accumulating the amount of time that the corresponding driver has spent on duty over a plurality of predetermined time intervals; and l. said control means including interval means for periodically indicating the passage of a predetermined time interval, said control means updating the contents of each of said plurality of fourth storage means to reflect the contents of said second storage means upon recognizing the passage of each predetermined time interval, and thereupon resetting the contents of each of said plurality of second storage means.

14. Recording apparatus as recited in claim 13 including a plurality N of storage means for each of the plurality of drivers for storing the contents of each of said plurality of second storage means for the N most recent predetermined time intervals, said control means summing the contents of said plurality N of storage means for each of the plurality of drivers upon recognizing the passage of each predetermined time interval and storing the sums in corresponding ones of said plurality of fourth storage means for allowing the contents of each of said plurality of fourth storage means to accumulate the amount of time that the corresponding driver has spent on duty over the N most recent predetermined time intervals.

15. Recording apparatus as recited in claim 14 including selection means coupled to said control means for selecting a value for N for the plurality of drivers from among a plurality of possible values.

16. Recording apparatus as recited in claim 13 wherein said control means resets the contents of each of said fourth storage means only after the off duty time stored by a corresponding one of said third storage means has reached a predetermined value.

* * * * *